US006840290B2

(12) United States Patent
Gregory et al.

(10) Patent No.: US 6,840,290 B2
(45) Date of Patent: Jan. 11, 2005

(54) PROCESS AND APPARATUS FOR FUELLING A MARINE VESSEL

(75) Inventors: Donald Michael Gregory, Staines (GB); Spencer Edwin Taylor, Surrey (GB)

(73) Assignee: BP Oil International Limited, London (GB)

( * ) Notice: Subject to any disclaimer, the term of this patent is extended or adjusted under 35 U.S.C. 154(b) by 45 days.

(21) Appl. No.: 10/433,151

(22) PCT Filed: Nov. 28, 2001

(86) PCT No.: PCT/GB01/05240

§ 371 (c)(1),
(2), (4) Date: Jun. 17, 2003

(87) PCT Pub. No.: WO02/46335

PCT Pub. Date: Jun. 13, 2002

(65) Prior Publication Data

US 2004/0040615 A1 Mar. 4, 2004

(30) Foreign Application Priority Data

Dec. 6, 2000 (GB) ..... 0029675

(51) Int. Cl.[7] ..... C10L 1/32
(52) U.S. Cl. ..... 141/9
(58) Field of Search ..... 141/9

(56) References Cited

U.S. PATENT DOCUMENTS

| | | | |
|---|---|---|---|
| 4,199,326 | A | 4/1980 | Fung |
| 4,333,422 | A | 6/1982 | Mahoney |
| 4,378,230 | A | 3/1983 | Rhee |
| 4,447,348 | A | 5/1984 | Forsberg |
| 4,477,258 | A | 10/1984 | Lepain |
| 4,492,338 | A | 1/1985 | Marelli |
| 4,666,620 | A | 5/1987 | Forsberg |
| 4,770,670 | A | 9/1988 | Hazbun et al. |
| 4,983,319 | A | 1/1991 | Gregoli et al. |
| 5,263,848 | A | 11/1993 | Gregoli et al. |
| 5,360,458 | A | 11/1994 | Forsberg et al. |
| 5,411,558 | A | 5/1995 | Taniguchi et al. |
| 5,445,656 | A | 8/1995 | Marelli |
| 5,792,223 | A | 8/1998 | Cardenas et al. |
| 5,863,301 | A | 1/1999 | Grosso et al. |
| 5,873,916 | A | 2/1999 | Cemenska et al. |
| 6,280,485 | B1 | 8/2001 | Daly et al. |
| 2001/0005955 | A1 | 7/2001 | Daves et al. |
| 2002/0014033 | A1 | 2/2002 | Langer et al. |

FOREIGN PATENT DOCUMENTS

| | | |
|---|---|---|
| CA | 2 145 030 | 9/1996 |
| EP | 0124 061 | 11/1984 |
| EP | 0 156 486 A | 10/1985 |
| EP | 0 162 591 A | 11/1985 |
| GB | 2 032 951 A | 5/1980 |
| WO | WO 93/18117 | 9/1993 |
| WO | WO 97/34969 | 9/1997 |
| WO | WO 98/21294 | 5/1998 |
| WO | WO 99/54426 | 10/1999 |

OTHER PUBLICATIONS

Gunnerman, R.W.; "Low–viscosity, clean–burning liquid fuel . . . units such as boilers and furnaces"; WO 9954426 A; (abstract).

Gunnerman, R.W.; "Aqueous stable, storable internal combustion engine fuel — . . . giving stability form at least three months"; WO 9527021 A; (abstract).

Gunnerman, R.W.; "Burning aqueous fuel in internal combustion engine — . . . in presence of catalyst producing hydrogen"; WO 9207922 A (abstract).

Gunnerman, R.W.; "Aqueous fuel for internal combustion engine—contains water and carbonaceous fuel and is combusted in presence of hydrogen–producing catalyst"; WO 9107579 A (abstract).

Coleman, G.N., et al; "Formulation of aqueous fuel emulsion composition for use in compression ignition engine"; WO 9931203 A (abstract).

Cemenska, R.A., et al; "Transportable fuel emulsion blending system, for blending . . . comprises fluid circuits on transportable platform"; WO 200032721 A (abstract).

Coleman, G.N., et al; "Reduced nitrogen oxide (NOx) emission fuel composition for internal combustion engines"; WO 9963024 A (abstract).

Coleman, G.N., et al; "Reduced nitrogen oxide (NOx) emission fuel composition for internal combustion engines"; WO 9963025 A (abstract).

Abraham, W.D. et al; "Emulsified water–blended fuel composition useful in internal . . . ammonia and/or amine and an amine salt"; WO 200015740 A (abstract).

Marcano, L.R. et al; "Utilization of viscous hydrocarbon combustible fuel for diesel engines"; EP 937768 A (abstract).

Chirinos, M. et al; "Using viscous hydrocarbon as combustible fuel — . . . invert emulsion, vaporising and burning"; DE 19704874 A (abstract).

Rivas, H.; "Multiple emulsion for use as transportable and combustible fuel—comprises continuous . . . compound suspended in inner water droplet phase"; EP 892035 A (abstract).

(List continued on next page.)

*Primary Examiner*—J. Casimer Jacyna
(74) *Attorney, Agent, or Firm*—Nixon & Vanderhye

(57) ABSTRACT

A process for fuelling a marine vessel having a diesel engine and/or a boiler, which comprises providing the marine vessel with a storage tank for high internal phase ratio (HIPR) emulsions comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock. The absence of cutter stock avoids incompatibility problems and may allow for use of the emulsion without settling, filtering and centrifuging.

26 Claims, No Drawings-

OTHER PUBLICATIONS

Nunez, G. et al; "Forming stable bimodal emulsion of viscous hydrocarbons in buffer—by mixing viscous . . . comprising water, alkali additive, etc."; GB 2295972 A (abstract).

Acevedo, S. et al; "Forming stable emulsion of viscous hydrocarbon—by providing viscous hydrocarbon contg surfactant, forming soln of buffer, and mixing buffer and hydrocarbon"; GB 2274254 A (abstract).

Gerardo, S. et al; "Stable low–viscosity bi–modal oil–in–water emulsion—comprising emulsifier, continuous aqueous phase and discontinuous oil–phase with two droplet sizes"; DE 4240396 A (abstract).

Marelli, E., "Fuel, particularly for diesel engines, has emulsive agent of specified Hydrophilic–Lipophilic Balance."; EP 1101815 A (abstract).

Dodd, P.J., et al; "Hydrocarbon oil–in–water emulsion for use as fuel in gas turbines—has minimal content of sodium, thus minimising damage to turbine blades"; WO 9708276 A (abstract).

Bongardt, F., et al; "Fuel mixture containes combustible hydrocarbons, water and emulsifiers made of fatty alcohols"; DE 19934689 A (abstract).

Berenbold, H., et al; "Stable fuel water emulsion free from alcohol, useful in internal combustion engine without catalyst — . . . emulsifier and polyalkylene glycol as stabiliser"; WO 9831773 A (abstract).

Ansell, L.L. et al; "Hydrocarbon water emulsion useful as fuels or for pipeline transportation"; WO 9913030 A; (abstract).

Berlowitz, P.J., et al; "Emulsion useful as fuel emulsion"; WO 9913031 A (abstract).

Ansell, L.L., et al; "Emulsion useful as fuel or for pipeline trasportation and their preparation"; WO 9913028 A (abstract).

Eiho Kogyo Yg; "Combustion method for water and oil emulsion fuel—involves burning emulsion fuel within fixed time . . . uniformly equal to specific diameter without change"; JP 11263991 A (abstract).

Marelli, E.; "Fuel, particularly for diesel engines, has emulsive agent of specified Hydrophilic–Lipophilic Balance"; EP 1101815 A (abstract).

Marelli, E.; "Emulsion production from immiscible liquids, especially liquid fuels and water"; EP 958853 A (abstract).

"Finland's Wasa pilot plant fires on Orimulsion"; Accession Nbr.: 2001:4525; Mar./Apr. 2001; (abstract).

PROCESS AND APPARATUS FOR FUELLING A MARINE VESSEL

This application is the U.S. national phase of international application PCT/GB01/05240, filed 28 Nov. 2001, which designated the U.S.

The present invention relates to an emulsion of fuel oil in water, and in particular, to an emulsion of marine fuel oil in water.

Within the marine industry, both distillate and residual fuel oils are employed; Such fuels tend to be stored on board the vessel and pumped to a diesel engine or boiler, where combustion takes place.

At low temperatures, marine fuels become relatively viscous, making them difficult to pump on board and around the vessel. One method of reducing the viscosity is by adding a diluent to the residual fuel oil. Typically, a light hydrocarbon cutter stock is employed. This thins the fuel sufficiently for it to be mobilised at low temperature to meet the requirements of the use. Cutter stocks, however, are of variable composition in terms of aromatic versus paraffinic character, and also contain insoluble contaminants, which have to be removed before the fuel is burnt. Conventionally, this removal is carried out on board the vessel, for example, using a complex arrangement of settling tanks, filters and centrifuges. Furthermore, a marine vessel fuelled by a conventional marine fuel can only be re-fuelled with a different marine fuel, if steps are taken to segregate the two fuels in the storage tanks owing to differences in solvent character. If such steps are not taken, sludging, resulting from asphaltene precipitation, can occur.

The use of emulsions to improve the transportation of heavy hydrocarbons is described in U.S. Pat. No. 5,863,301 and CA 2145030. The preparation and use of emulsions is also described in EP0156486A and EP0162591 A.

WO 99/54426 relates to aqueous macroemulsions based upon vacuum resid, visbroken vacuum resid, liquified coke, and fuel oils Nos. 4, 5 and 6 which are said to be a useful substitute for non-emulsified fuel oil. However, since fuel oils no.s 4, 5 and 6 also contain hydrocarbon cutter stocks the potential still exists for incompatibility problems.

It has now been found that emulsions made using fuel oil in the substantial absence of hydrocarbon cutter stock may be mixed without the potential incompatibility problems. This is particularly advantageous for marine vessels, since it obviates the need for the complex arrangement of settling tanks, filters and/or centrifuges.

Thus, according to the present invention there is provided a process for fuelling a marine vessel having a diesel engine and/or a boiler, which process comprises:

(a) providing said marine vessel with a storage tank operably connected to said diesel engine and/or boiler;

(b) introducing into said storage tank a first high internal phase ratio (HIPR) emulsion (A) comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock; and (c) introducing into said storage tank optionally containing emulsion (A), a second high internal phase ratio (HIPR) emulsion (B) comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock;

and in which the emulsions (A) and (B) are different from each other.

The emulsions of the present invention, have reduced viscosity.

The phase ratio of the emulsions may be independently 10 to 60% water, preferably 30 to 50% water, more preferably, 30 to 40% water.

The emulsions, which are typically, highly concentrated, preferably comprise fuel oil droplets having a mean diameter of 2 to 50 microns, preferably, 10 to 30 microns. At very low concentrations of water, typically less than 25%, the fuel oil will be distributed as distorted droplets separated by thin films of water and may, as a consequence, be too viscous for the application.

Preferably, the emulsions are pumpable without the application of heat, even at ambient temperature (eg 5° C.). The viscosity of the emulsions at 25° C. may be 100 to 1000 cSt, preferably, 100 to 500 cSt and most preferably, 100 to 300 cSt.

Preferably, the emulsions independently comprise 20 to 50 vol % water, more preferably, 30 to 40 vol %.

Preferably, the emulsions independently comprise 50 to 80 vol % fuel oil, more preferably, 60 to 70 vol %.

Suitable fuel oils include residual oils from refinery processing such as atmospheric residues, vacuum distillation residues, visbreaker residues and other heavy refinery streams. The initial viscosity of the fuel oil at 50° C. may be 1000 to 100,000 cSt, preferably, 500 to 1,000 cSt.

The emulsions may independently further comprise a surfactant. Suitable surfactants include non-ionic surfactants, anionic surfactants, cationic surfactants and mixtures thereof.

Suitable non-ionic surfactants include ethoxylated alkyl phenols, ethoxylated alcohols and ethoxylated sorbitan esters.

Suitable anionic surfactants include the salts of long (eg hydrocarbon) chain carboxylic and sulphonic acids, and long (eg hydrocarbon) chain sulphates.

Suitable cationic surfactants include the hydrochlorides of fatty diamines, imidazoles, ethoxylated amines, amidoamides and quaternary ammonium compounds.

When a surfactant is employed, it may be present in an amount of 0.1 to 5 wt % based on the total weight of the emulsion.

The emulsions of the present invention may also independently comprise conventional fuel additives. Suitable additives may include ignition improvers, combustion improvers, corrosion inhibiters, biocides, SOx reducing agents, NOx reducing agents, ash modifiers and soot release agents.

Advantageously water-soluble additives are compatible with the emulsions of the present invention, as they can dissolve in the continuous water phase surrounding the fuel oil droplets of the emulsion. These may optionally be added to the prepared emulsion, or to the aqueous phase prior to emulsification.

The emulsions of the present invention may be prepared using any suitable method. For example, the emulsions may be prepared by mixing the fuel oil directly with water. The mixing may be carried out under low shear conditions in the range of 10 to 1000, preferably, 50 to 250 $s^{-1}$. The mixing may be carried out in the presence of a suitable surfactant. Alternatively, the fuel oil may be mixed directly with an aqueous solution of a suitable surfactant.

The emulsions of the present invention is particularly useful for diesel engines designed to operate with heavy fuel oils, more preferably, marine heavy fuel diesel engines.

Accordingly, the present invention also provides a method of fuelling a heavy fuel diesel engine, which method comprises introducing an emulsion of the present invention into said engine.

Advantageously, the emulsions of the present invention are of sufficiently low viscosity, allowing them to be mobilised from the storage tanks to the fuel engine in a convenient manner. Thus, although the emulsions may be preheated to enhance their mobility to or around the vessel, pre-heating is not essential.

Because of their relatively low viscosity, the emulsions of the Present invention need not contain hydrocarbon cutter stocks. In fact, hydrocarbon cutter stocks are substantially absent from the emulsions of the present invention. This is advantageous because cutter stocks are often aromatic, and have a detrimental effect on the combustion and ignition quality of the fuel. Moreover, cutter stocks tend to contain significant amounts of insoluble contaminants. Thus, in the substantial absence of such stocks, the levels of insoluble contaminants in the emulsions may be relatively low, for example, less than 20 ppm, preferably, below 1 ppm based on the total weight of the emulsion.

When the amount of insoluble contaminants in the emulsion is below 20 ppm, it may not be necessary to rid the emulsion of such contaminants prior to use. This is particularly advantageous on marine vessels, because the equipment conventionally employed to remove solid contaminants from marine fuel tends to be complex and bulky. When an emulsion of the present invention is employed as a marine fuel, the emulsion may be pumped from the storage tank of the vessel to the fuel engine, without the need for processing the emulsion through the various settling, filtering and/or centrifugation steps. Indeed, in many circumstances, it is undesirable to subject the emulsion to, eg centrifugation, which may tend to cause separation of the emulsion into its components. In one embodiment of the invention, the emulsion is mobilised directly from the storage tank to the fuel engine.

Another advantage that the emulsion of the present invention has over a conventional fuel oil is that, whereas a mixture of two different fuel oils may be too unstable for storage, a mixture of two different emulsions of the present invention may not be. This increased miscibility is related to the presence of a common water phase and surfactant type surrounding the fuel oil droplets of each emulsion. Because of this miscibility and enhanced compatibility, a marine vessel fuelled by an emulsion of the present invention may be re-fuelled with a different emulsion, without problems (incompatibility) arising from the second emulsion coming into contact with any residual first emulsion in the storage tank. In contrast, a marine vessel fuelled by a conventional marine fuel can only be re-fuelled with a different marine fuel, if steps are taken to segregate the two fuels in the storage tanks. If such steps are not taken, "sludging", resulting from asphaltene precipitation, can occur.

The invention will now be described by way of example only by reference to the following experiments.

Separate emulsions were prepared from two uncut vacuum residue feedstocks from BP's Coryton and Grangemouth refineries in the UK were prepared based on the "High Internal Phase Ratio (HIPR)" method described in EP-A-0156486 and EP-A(0162591.) These are called emulsions C and G, respectively.

Each residue was heated to 70° C. 5 parts by weight of each residue were added to one part by weight of a 2 wt % solution of Igepal CA-630 (octylphenol 9-ethoxylate) in deionised water, originally at ambient temperature. The components were then mixed using a hand-held low speed (1200 rpm) domestic mixer for one minute to produce an HIPR emulsion, exhibiting a smooth texture. Owing to the relative densities of the components, the use of parts by volume and parts by weight can be considered to be interchangeable. After the initial mixing stage, further quantities of deionised water can be added as a dilution stage. In this way, 65% by weight residue emulsions C and G, stabilized by approximately 0.25 wt % surfactant were produced.

Droplet size distributions were determined for emulsions C and G using a Galai CIS-1 instrument, and these exhibited droplet diameters in the range 5 to 40 microns, with volume mean statistical diameters of approximately 20 microns. Modification of the emulsification conditions (for example, surfactant type, surfactant concentration, first stage mixing time and speed) allows emulsions with mean diameters between 5 and 30 microns to be produced.

Storage stability tests on each of emulsions C, G and 50:50 binary combinations made therefrom were conducted, and their droplet size distributions monitored as a function of time at 40° C. This method is common practice when attempting to identify signs of instability in emulsions. No evidence of time-dependent instability could be found. This shows that these two emulsions are compatible and can be mixed with each other in these tests.

What is claimed is:

1. A process for fuelling a marine vessel having a diesel engine and/or a boiler, which process comprises:

(a) providing said marine vessel with a storage tank operably connected to said diesel engine and/or boiler;

(b) introducing into said storage tank a first high internal phase ratio (HIPR) emulsion (A) comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock; and (c) introducing into said storage tank optionally containing emulsion (A), a second high internal phase ratio (HIPR) emulsion (B) comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock;

and in which the emulsions (A) and (B) are different from each other.

2. A process as claimed in claim 1 in which emulsion is pumped to the diesel engine and/or boiler without settling, or without filtering or without centrifuging or without settling, filtering and centrifuging.

3. A process as claimed in claim 2 in which emulsion is pumped directly from the storage tank to the diesel engine and/or boiler.

4. A process as claimed in claim 1 wherein the emulsions comprise less than 20 ppm insoluble contaminants.

5. A process as claimed in claim 1 wherein the fuel oil in each of the emulsions independently has a viscosity at 50° C. of 1000 to 100,000 cSt.

6. A process as claimed in claim 1 wherein the emulsions independently comprise a surfactant.

7. A process as claimed in claim 5 wherein the emulsions independently comprise a surfactant.

8. A process as claimed in claim 1 wherein the emulsions independently comprise fuel oil droplets having a mean diameter of 2 to 50 microns, preferably, 10 to 30 microns.

9. A process as claimed in claim 5 wherein the emulsions independently comprise fuel oil droplets having a mean diameter of 2 to 50 microns, preferably, 10 to 30 microns.

10. A process as claimed in claim 6 wherein the emulsions independently comprise fuel oil droplets having a mean diameter of 2 to 50 microns, preferably, 10 to 30 microns.

11. A process as claimed in claim 7 wherein the emulsions independently comprise fuel oil droplets having a mean diameter of 2 to 50 microns, preferably, 10 to 30 microns.

12. A process as claimed in claim 1 wherein the emulsions independently comprise 20 to 50 vol % water, more preferably, 30 to 40 vol %.

13. A marine vessel for use in the process of claim 1 which vessel comprises a diesel engine and/or boiler and a storage tank operably connected thereto without settling tanks, or without filters, or without centrifuges or without settling tanks, filters and centrifuges.

14. A marine vessel as claimed in claim 13 in which the storage tank is directly connected to the diesel engine and/or boiler.

15. A process for fuelling a marine vessel having a diesel engine and/or a boiler, said marine vessel having a storage tank operably connected to said diesel engine and/or boiler and said storage tank containing residual first high internal phase ratio (HIPR) emulsion (A) comprising 10–40% by weight water and a fuel oil comprising at least one member selected from the group consisting of atmospheric residues, vacuum distillate residues, visbreaker residues and other heavy refinery streams in the substantial absence of hydrocarbon cutter stock, which process comprises re-fuelling said vessel by introducing into said storage tank a second high internal phase ratio (HIPR) emulsion (B) comprising 10–40% by weight water and a fuel oil comprising at least one member selected from the group consisting at atmospheric residues, vacuum distillate residues, visbreaker residues and other heavy refinery streams in the substantial absence of hydrocarbon cutter stock; and in which the emulsions (A) and (B) are different from each other.

16. A process as claimed in claim 15 in which emulsion is pumped to the diesel engine and/or boiler without settling, or without filtering or without centrifuging or without settling, filtering and centrifuging.

17. A process as claimed in claim 16 in which emulsion is pumped directly from the storage tank to the diesel engine and/or boiler.

18. A process as claimed in claim 15 wherein the emulsions comprise less than 20 ppm insoluble contaminants.

19. A process as claimed in claim 15 wherein the fuel oil in each of the emulsions independently has a viscosity at 50° C. of 1000 to 100,000 cSt.

20. A process as claimed in claim 15 wherein the emulsions independently comprise a surfactant.

21. A process as claimed in claim 19 wherein the emulsions independently comprise a surfactant.

22. A process as claimed in claim 15 wherein the emulsions independently comprise fuel oil droplets having a mean diameter of 2 to 50 microns, preferably, 10 to 30 microns.

23. A process as claimed in claim 19 wherein the emulsions independently comprise fuel oil droplets having a mean diameter of 2 to 50 microns, preferably, 10 to 30 microns.

24. A process as claimed in claim 20 wherein the emulsions independently comprise fuel oil droplets having a mean diameter of 2 to 50 microns, preferably, 10 to 30 microns.

25. A process as claimed in claim 21 wherein the emulsions independently comprise fuel oil droplets having a mean diameter of 2 to 50 microns, preferably, 10 to 30 microns.

26. A process as claimed in claim 15 wherein the emulsions independently comprise 20 to 50 vol % water, more preferably, 30 to 40 vol %.

* * * * *